US011352851B2

(12) United States Patent
Ross et al.

(10) Patent No.: US 11,352,851 B2
(45) Date of Patent: Jun. 7, 2022

(54) WELL WITH TWO CASINGS

(71) Applicant: METROL TECHNOLOGY LIMITED, Aberdeen (GB)

(72) Inventors: Shaun Compton Ross, Aberdeen (GB); Leslie David Jarvis, Stonehaven (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 0 days.

(21) Appl. No.: 16/647,741

(22) PCT Filed: Sep. 18, 2018

(86) PCT No.: PCT/GB2018/052660

§ 371 (c)(1),
(2) Date: Mar. 16, 2020

(87) PCT Pub. No.: WO2019/063974

PCT Pub. Date: Apr. 4, 2019

(65) Prior Publication Data

US 2020/0224514 A1 Jul. 16, 2020

(30) Foreign Application Priority Data

Sep. 26, 2017 (GB) ..... 1715586

(51) Int. Cl.
*E21B 34/06* (2006.01)
*E21B 34/16* (2006.01)
(Continued)

(52) U.S. Cl.
CPC ..... *E21B 34/066* (2013.01); *E21B 34/063* (2013.01); *E21B 34/16* (2013.01); *E21B 47/12* (2013.01); *E21B 33/1212* (2013.01)

(58) Field of Classification Search
CPC ..... E21B 34/06; E21B 34/066
See application file for complete search history.

(56) References Cited

U.S. PATENT DOCUMENTS 5,316,086 A 5/1994 DeMoss
2002/0170749 A1 11/2002 Hoyer et al.
(Continued)

FOREIGN PATENT DOCUMENTS

GB 2109895 A * 11/1981
WO 2002084067 10/2002
(Continued)

OTHER PUBLICATIONS

International Search Report for PCT/GB2018/052660, dated Dec. 10, 2018.
(Continued)

*Primary Examiner* — Kristyn A Hall
(74) *Attorney, Agent, or Firm* — Womble Bond Dickinson (US) LLP

(57) ABSTRACT

A well (10) in a geological structure (11), the well (10) comprising: a first casing string (12*a*) and a second casing string (12*b*) inside the first casing string (12*a*) and defining a first inter-casing annulus (14*a*) therebetween. A wirelessly controllable valve (16*a*), in the second casing string (12*b*) provides fluid communication between the first inter-casing annulus (14*a*) and a second casing bore (14*b*). The first or second casing string are less than 250 meters longer in length than the second or first casing string respectively and may be the same length. The distal ends of the first and second casing strings may be in a substantially impermeable formation (11). A number of benefits can be realised from such an arrangement. For example, in the event of a "blow-out", kill fluid may be introduced into the well bore without the need to drill a relief well.

24 Claims, 3 Drawing Sheets

(51) Int. Cl.

| | |
|---|---|
| ***E21B 47/12*** | (2012.01) |
| *E21B 33/12* | (2006.01) |

(56) References Cited

U.S. PATENT DOCUMENTS

| | | | | |
|---|---|---|---|---|
| 2006/0196539 | A1* | 9/2006 | Raska ..... | E21B 34/063 137/68.24 |
| 2015/0240592 | A1 | 8/2015 | Ross et al. | |
| 2016/0053542 | A1 | 2/2016 | Stafford | |

FOREIGN PATENT DOCUMENTS

| | | |
|---|---|---|
| WO | 2004079240 | 9/2004 |
| WO | 2011067372 | 6/2011 |
| WO | 2016057014 | 4/2016 |
| WO | 2017027978 | 2/2017 |
| WO | 2019063972 | 4/2019 |
| WO | 2019063973 | 4/2019 |

OTHER PUBLICATIONS

Mingge He et al, "A New Completion Hardware: Intelligent Casing Sleeve Based on Electromagnetic Wireless Communication", Society of Petroleum Engineers, SPE-181794-MS, 2016.

Mikolaj Ralowski, "Design of a hypothetical relief well for a shallow reservoir, possible challenges", University of Stavanger, May 30, 2016, pp. 15-32.

UKIPO Combined Search and Examination Report for GB Application No. 1715586.2, dated Feb. 19, 2018.

GCC Patent Office Examination Report for Corresponding Gulf Cooperation Application No. 2018/36076, dated Dec. 14, 2020.

Examination Report for Corresponding Gulf Cooperation application 2018/36076, dated Sep. 6, 2021.

* cited by examiner

WELL WITH TWO CASINGS

CROSS REFERENCE TO RELATED APPLICATIONS

This application is a 35 U.S.C. 371 National Stage of International Application No. PCT/GB2018/052660, titled "A WELL WITH TWO CASINGS", filed Sep. 18, 2018, which claims priority to GB Application No. 1715586.2, titled "A WELL WITH TWO CASINGS", filed Sep. 26, 2017, all of which are incorporated by reference herein in their entirety.

This invention relates to a well in a geological structure.

The drilling of boreholes, particularly for hydrocarbon wells, is a complex and expensive exercise. Reservoir conditions and characteristics need to be considered and evaluated constantly during all phases of the well's life so that it is designed and positioned to recover hydrocarbons as safely and efficiently as possible.

A borehole having a first diameter is initially drilled out to a certain depth and a casing string run into the borehole. A lower portion of the resulting annulus between the casing string and borehole is then normally cemented to secure and seal the casing string. The borehole is normally extended to further depths by continued drilling below the cased borehole at a lesser diameter compared to the first diameter, and the deeper boreholes then cased and cemented. The result is a borehole having a number of generally nested tubular casing strings which progressively reduce in diameter towards the lower end of the overall borehole.

As technology has advanced, and the understanding of borehole geometry and hydrocarbon geology has improved, companies have been able to extend the potential areas for finding and producing from downhole reservoirs. For example, in recent years hydrocarbons have been recovered from offshore subsea wells in very deep water, of the order of over 1 km. This poses many technical problems in drilling, securing, extracting, suspending and abandoning wells at such depths.

In a subsea environment a Blow-Out-Preventer (BOP) is connected to the drilling rig by way of a marine riser. Drill pipe can be lowered down through one or more of the marine riser, through the BOP, into a wellhead, and then down into the well to drill deeper into the ground. As drilling fluid or mud is pumped through the drill pipe and out through the drill bit, it circulates all the way around up through the marine riser back to the surface facility.

As the drill bit continues to make its way towards the hydrocarbons or 'pay zone', the drilling company closely monitors the amount of drilling fluid in storage tanks as well as the pressure of the formation(s) to ensure that the well is not experiencing a blow-out or 'kick'.

Drilling fluid can be much heavier than sea water, in some cases more than twice as heavy. This is helpful when drilling a well because its weight creates enough head pressure to keep any pressure in the hydrocarbon formation(s) from escaping back up through the well. The heavier the drilling fluid used when drilling a well, the less likely it is that formation pressure escapes back up into the well and up the marine riser. On the other hand, if the drilling fluid used whilst drilling is too heavy, there is a risk of losing fluid to the well and/or loosing well control. When this happens the drilling fluid begins leaking out into the underground formation(s). This is an issue because without being able to circulate the drilling fluid back to the surface, it will not be possible to drill any deeper. Moreover, when drilling fluid is lost there will be less drilling fluid in the fluid column above the drill bit, thus reducing its hydrostatic pressure, and possibly resulting in a 'kick' or blow-out from the well. As the well is drilled deeper and deeper, the drilling fluid weight operating window gets smaller and smaller and the potential for a kick/blow-out/loss of well control situation occurring increases.

In the event of a failure in the integrity of a subsea well, wellhead control systems are known to shut the well off to prevent a dangerous blow-out, or significant hydrocarbon loss from the well. The BOP can be activated from a control room to shut the well. Should this fail, a remotely operated vehicle (ROV) can directly activate the BOP at the seabed to shut the well.

In a completed well, rather than a BOP, a Christmas Tree is provided at the top of the well and a subsurface safety valve (SSSV) is normally added downhole. The SSSV is normally near the top of the well. The SSSV is normally activated to close and shut the well if it loses communication with the controlling platform, rig or vessel. A wellhead may comprise a BOP or a Christmas tree.

Despite these known safety controls, accidents still occur and a blow-out from a well can cause an explosion resulting in loss of life, loss of the rig and a significant and sustained escape of hydrocarbons into the surrounding area, threatening workers, wildlife and marine and/or land based industries. Blow-outs can also occur downhole in the formations and possibly cause a rupture in the earth's surface away from the well, which are particularly difficult to deal with. The well in the geological structure may be any offshore or land based well.

In the event of a major failure in the integrity of a well, a relief well has traditionally been drilled to intersect and control the well but drilling takes time and the longer it takes, the more hydrocarbon and/or drilling/well fluids are typically released into the environment.

An object of the present invention is to mitigate problems with the prior art, and provide a well controllable by alternative means.

According to a first aspect of the present invention there is provided a well in a geological structure, the well comprising:

- a first and a second casing string, the second casing string inside the first casing string;
- the first and second casing strings defining a first inter-casing annulus therebetween, the second casing string defining a second casing bore therewithin;
- a primary fluid flow control device in the second casing string to provide fluid communication between the first inter-casing annulus and the second casing bore;
- wherein the first or second casing string is less than or equal to 250 meters longer in length than the second or first casing string respectively
- wherein the primary fluid flow control device comprises a wirelessly controllable valve.

According to a second aspect of the present invention there is provided a well in a geological structure, the well comprising:

- a first and a second casing string, the first and second casing string each having a proximal and a distal end, the second casing string inside the first casing string;
- the first and second casing strings defining a first inter-casing annulus therebetween, the second casing string defining a second casing bore therewithin;
- a primary fluid flow control device in the second casing string to provide fluid communication between the first inter-casing annulus and the second casing bore; and wherein the distal ends of the first and second casing strings are in an impermeable or at least substantially impermeable formation.

The impermeable or at least substantially impermeable formation is not a permeable formation.

When we refer to the impermeable or at least substantially impermeable formation this is typically less permeable than a permeable formation therebelow. The permeable formation is typically a formation containing hydrocarbons. The permeable formation may be referred to as a reservoir. The permeable formation is typically therefore at least one of the formations that fluids are expected to flow naturally from. The fluids may be formation fluids. The fluids normally comprise hydrocarbons.

According to a third aspect of the present invention there is provided a well in a geological structure, the well comprising:

a first and a second casing string, the first and second casing string each having a proximal and a distal end, the second casing string inside the first casing string;

the first and second casing strings defining a first inter-casing annulus therebetween, the second casing string defining a second casing bore therewithin;

a primary fluid flow control device in the second casing string to provide fluid communication between the first inter-casing annulus and the second casing bore; and wherein the distal ends of the first and second casing strings are not in a permeable formation.

The first or second casing string is typically less than or equal to 100 meters longer in length than the second or first casing string respectively. The first or second casing string may be less than or equal to 50 meters longer in length than the second or first casing string respectively.

The first and the second casing strings are typically substantially the same length. The first and the second casing strings are normally the same length.

The first and second casing string typically each having a proximal and distal end, the proximal ends closest to surface. The proximal end of the first casing string is typically within 50 meters, normally 10 meters and may be 5 meters of the proximal end of the second casing string. The distal end of the first casing string is typically within 200 meters, normally 100 meters and may be 50 meters of the distal end of the second casing string.

The geological structure typically comprises a reservoir that contains hydrocarbons. The well typically includes one or more communication paths providing fluid communication between the reservoir and the well. There is normally an uppermost communication path, that is a communication path that is closest to surface. The reservoir may be referred to as a producing formation.

The communication path may be any fluid path between the formation or reservoir and the well. The one or more communication paths may be an annulus between a wellbore and formation whilst or after drilling or can be perforations created in the well and surrounding formation by a perforating gun. In some cases use of a perforating gun to provide the one or more communication paths is not required. For example, the well may be open hole and/or it may include a screen/gravel pack, slotted sleeve or slotted liner or has previously been perforated.

The primary fluid flow control device may be within 1500 meters, typically within 1000 meters, normally within 500 meters and optionally within 100 meters of the uppermost communication path of the well between the reservoir and the well.

The primary fluid flow control device may be within 500 meters, typically within 300 meters and optionally within 100 meters from the distal end of the shallower of the first and second casing strings, or if they are the same length, from each distal end.

The distal end of the shallower of the first and second casing string may be within 200 meters, typically within 100 meters, normally within 50 meters of the uppermost communication path of the well.

The first and/or second casing string does not typically extend into the reservoir. The lowermost end of the first and/or second casing string is typically above the uppermost communication path between the reservoir and the well.

The first and second casing strings typically extend to substantially the same or same position in the geological structure.

The lowermost ends of the first and second casing strings are typically at the same position in the geological structure. The lowermost end of the first casing string may be within 200 meters, normally 100 meters, optionally 50 meters of the lowermost end of the second casing string.

The distal end of the second casing string is typically inside the first casing string. Conventionally the distal end of the second casing string would not be in the first casing string, rather the distal end of the second casing string would be spaced away from, normally substantially spaced away from the first casing string. It may be an advantage of the present invention that if the distal end of the second casing string is inside the first casing string, only one trip with a drill string needs to be made to penetrate the distal ends of both the first and second casing strings. Every trip down hole takes time and costs money so this may save time and money compared to conventional well construction techniques and arrangements.

The well may be an onshore well or an offshore and/or subsea well.

The well normally further comprises a fluid port in the first inter-casing annulus. The fluid port may be a well head port which may be at or adjacent a well head. The well head fluid port may be at surface for land wells or at the seabed for subsea wells. There may be more than one well head fluid port. A relief well and/or an interface between a relief well and the well and/or casing of the well may be referred to as a fluid port.

The fluid port may be in the side and/or wall of the first casing string. There may be two or more fluid ports in the first casing string.

In use, a fluid may be introduced into the first inter-casing annulus through the fluid port. The fluid may be introduced into the first inter-casing annulus at a wellhead at or adjacent or directly at the wellhead. This is particularly suitable for onshore and/or offshore platform wells where access to the first inter-casing annulus is more common.

The fluid may be, or may be referred to as, a kill fluid. The fluid is normally a drilling mud-type fluid but other fluids such as brine and cement may be used. The fluid is typically a liquid. Kill fluid is any fluid, sometimes referred to as kill weight fluid, which is used to provide hydrostatic head typically sufficient to overcome well, formation and/or reservoir pressure.

Conventionally in a subsea completed well, fluid porting is not provided at the surface of the well to the outer annuli. According to the present invention, there may be a subsea well with fluid porting into the first inter-casing annulus. Conventionally, fluid ports are not provided into the annuli due to the complexities involved in a subsea completed well. Embodiments of the present invention provide an advantage that access to multiple casing annuli and/or casing bores can be provided by a single fluid port at surface into an annuli.

It may be an advantage of the present invention that using the fluid port in the first casing string and the primary fluid flow control device in the second casing string, fluid can be introduced low down in the second casing bore, that is typically deep in the well, that is typically near the the reservoir in the geological structure that contains hydrocarbons.

This may be particularly useful when the reservoir contains fluids, typically hydrocarbons, at high temperature and/or high pressure. High temperature is typically above 125° C., normally above 150° C. High pressure is typically above 350 bar, normally above 700 bar. This may be particularly useful to manage the hydrostatic head, particularly when this is not possible by alternative means, such as an internal tubular.

Features and optional features of the third aspect of the present invention may be incorporated into the first, second and/or fourth aspects of the present invention and vice versa.

According to a fourth aspect of the present invention there is provided a method of fluid management in a subsea well, the well comprising:

a first and a second casing string, the first and second casing string each having a proximal and a distal end, the second casing string inside the first casing string;

the first and second casing strings defining a first inter-casing annulus therebetween, the second casing string defining a second casing bore therewithin;

a primary fluid flow control device in the second casing string to provide fluid communication between the first inter-casing annulus and the second casing bore; and a fluid port in the first casing string to provide fluid communication between the first inter-casing annulus and an outside of the first inter-casing annulus;

wherein the primary fluid control device is at the distal end of the second casing string and the fluid port is at the proximal end of the first casing string, the method of fluid management including the steps of:

introducing a fluid into the first inter-casing annulus through the fluid port;

opening the primary fluid flow control device; and directing the fluid between the first inter-casing annulus and the second casing bore.

Features and optional features of one aspect of the present invention may be incorporated into one or other aspects of the present invention and vice versa and are not repeated for brevity.

In the course of drilling a well the hydrostatic pressure to prevent fluids flowing naturally from the reservoir is managed in the second casing bore by circulating fluids through an internal tubular, such as a drill string. It may be an advantage of the present invention that this well and method of fluid management provides an alternate fluid path to manage fluids in the second casing bore. This may be particularly advantageous when circulating through the internal tubular is not possible or the internal tubular is not present.

In the event of loss of well control of a conventional well it may be necessary to drill a relief well to provide a way of introducing fluids into the well bore. It may be an advantage of the present invention that this well and method of fluid management provides a way of introducing fluids into the well bore without the need to drill a relief well. It may be a further advantage of the present invention that this well and method of fluid management provides an alternative fluid path that is in situ and available at all times and in particular prior to penetrating a permeable formation and/or reservoir.

The method of fluid management may provide a circulation path in the well and/or introduce fluids into the well and/or formation.

When drilling into a reservoir containing fluids at high temperature and/or high pressure there is a risk that when the drill string is pulled out, the hydrocarbons in the reservoir rise up the well and out at surface. It may be an advantage of the present invention that the method of fluid management provides an alternative fluid circulation path to control and typically mitigate the flow of hydrocarbons up the well.

The proximal ends of the first and second casing strings are typically closest to surface.

An injection line may be attached to the wellhead to provide fluid communication with the first inter-casing annulus, such that the fluid may be introduced. This is often safer and/or easier than introducing the fluid into the first inter-casing annulus at the wellhead whilst the well is blowing out.

Alternatively, fluid may be introduced into the first inter-casing annulus via the primary fluid flow control device and vented and/or produced via the fluid port.

The first inter-casing annulus is typically the so called 'B' annulus although it may be another annulus, especially an outer inter-casing annulus, depending on the circumstances of the well control/blow-out and the well construction and/or infrastructure.

The well may be used in a method of killing the well. Killing the well normally involves stopping flow of produced fluids up the well to surface. Killing the well may include balancing and/or reducing fluid pressure in the well to regain control of the well, and is not limited to stopping it from flowing or its ability to flow, though it may do so.

The method of fluid management may be used to maintain control and/or manipulate the pressure conditions in the well. Maintaining, controlling and/or manipulating of the pressure conditions in the well may involve one or more of increasing, decreasing and keeping the said conditions substantially constant. Examples of the pressure conditions comprise the hydrostatic pressure in the well, the density of the fluids in the well, or the flow rate of the fluids in the well.

When drilling, the pressure in the well, especially the hydrostatic pressure at the bottom of the well, is normally maintained above the reservoir pressure, to assist in well control and inhibit fluids escaping from the top of the well whilst drilling i.e. to resist 'blowing out'.

Nevertheless, this may lead to several problems, especially in very deep wells with larger hydrostatic heads. For example, it may lead to differential sticking of the drill pipe to the wellbore wall, or it may cause loss of the drilling mud into the formation, which wastes drilling fluid, may in turn damage the fractures therein or indeed can inadvertently lose pressure control of the well.

An alternative is for the hydrostatic pressure to be deliberately lowered in a section of the well, for example, by injecting lighter fluid, typically gas, into the drilling mud. This reduces the density of the overall fluid mixture in that section, whilst the well pressure is controlled by higher density drilling fluid in other sections of the well.

The inventors of the present invention recognise that the well and method of fluid management provide an alternative path through which fluids for such drilling can be injected through the flow control devices into the well in a controlled manner, thereby allowing for a more effective management of well integrity.

Thus, fluid may be directed through a flow control device whilst drilling.

The second casing bore may contain one or more of a well internal tubular, a production tubing, a completion tubing, a drill pipe, a fluid flow control device, one or more sensors, one or more batteries and one or more transmitters, receivers or transceivers. The well internal tubular may be any one or more of a casing, liner, production tubing, completion tubing, well test tubing, drill pipe, injection tubular, observation tubular, abandonment tubular, and subs, cross overs, carriers, pup joints and clamps for the aforementioned.

The first casing string may not be the outermost casing string. The casing string(s) may be referred to and/or comprise a liner(s). The casing string(s) may not extend to the top of the well and/or the surface. There may be a further casing string(s) of a larger diameter and therefore typically outside the first casing string.

In an open position, the primary fluid flow control device typically has a cross-sectional fluid flow area of at least 100 $mm^2$, normally at least 200 $mm^2$, and may be at least 400 $mm^2$ The primary fluid flow control device may comprise a plurality of apertures, the plurality of apertures having a total cross-sectional fluid flow area of at least 100 $mm^2$, normally at least 200 $mm^2$, and may be at least 400 $mm^2$.

It may be an advantage of the present invention that the primary fluid flow control device provides adequate and/or sufficient fluid flow between the first inter-casing annulus and the second casing bore to help control the well, for example in the event of a failure in the integrity of the well, such as a kick or a blow-out, and/or significant hydrocarbon loss from the well.

There may be further fluid flow control devices in the second casing string. There may be more than one primary fluid flow control device in the second casing string. Casing strings with valves are known but the valves are typically used for pressure equalisation. The inventors of the present invention have appreciated that the primary fluid flow control device can be used to provide fluid communication between the first inter-casing annulus and the second casing bore to manage fluids in the well and/or control the well and/or control a well kick or blow-out, if the cross-sectional fluid flow area of the primary fluid flow control devices is adequate and/or sufficient and therefore of at least 100 $mm^2$, normally at least 200 $mm^2$, and may be at least 400 $mm^2$. This is not provided for by valves used for pressure equalisation.

In use, the primary fluid flow control device is opened and fluid is directed between the first inter-casing annulus and the second casing bore. Before the primary fluid flow control device is opened, fluid communication between the first inter-casing annulus and the second casing bore is typically one or more of resisted, mitigated and prevented.

The first inter-casing annulus may be referred to as a first casing bore.

The primary fluid flow control device comprises a valve. The valve normally further comprises a check valve. The primary fluid flow control device typically further comprises a rupture mechanism.

The valve may have a valve member. The valve and/or valve member is typically moveable from a first closed position to a second open position. Optionally the valve and/or valve member can move to a further closed position or back to the first closed position. The valve may comprise more than one valve member.

The valve of the primary fluid flow control device is a wirelessly controllable valve. The valve of the primary fluid flow control device is normally at least one of an acoustic, electromagnetic and pressure-pulse wirelessly controllable valve.

The inventors of the present invention recognise that the wireless control of the valve allows for the valve and/or the valve member to be movable between the different positions against the local pressure conditions in the well. This provides an advantage over check valves commonly used in conventional wells, wherein the corresponding movable elements move in response to the change in the local pressure conditions. Thus, unlike the wirelessly controllable valve of embodiments of the present invention, conventionally used check valves may not be moved against the local pressure conditions in the well. For certain embodiments, such a wirelessly controllable valve may be provided in addition to a check valve. The wireless control may especially be pressure pulsing, acoustic or electromagnetic control; more especially acoustic or electromagnetic control.

Indeed, it is considered that the skilled person may be deterred from adding a valve to a casing as potential leak path. However the use of a controllable valve for such embodiments ensures pressure integrity of the casing.

The primary fluid flow control device is normally electrically powered. The primary fluid flow control device is typically powered by a downhole power source. The primary fluid flow control device may be battery powered.

At least one, optionally each, flow control device may include a metal to metal seal. For example, a valve member and a valve seat may be made from metal, such as a nickel alloy.

The valve and/or valve member may be moveable to a check position, that may be a position between a closed position and an open position. The valve may only allow fluid flow in one direction. The valve may resist fluid flow in one direction.

The primary fluid flow control device may comprise a valve, casing valve or rupture mechanism. The rupture mechanisms referred to above and below may comprise one or more of a rupture disk, pressure activated piston and a pyrotechnic device. The pressure activated piston may be retainable by a shear pin.

The rupture mechanism may be designed to preferentially rupture in response to fluid pressure from one side, typically an outer side. The rupture mechanism may only rupture in response to fluid pressure in the first inter-casing annulus. The well may further comprise a rupture mechanism in the first casing string. Pressurising fluid on an outside of the first casing string may cause the rupture mechanism in the first casing string to rupture, thereby initiating fluid flow into the first inter-casing annulus.

The well may further comprise one or more sensors at one or more of a face of the geological structure, in the well, in the first inter-casing annulus, in the second casing bore, in and/or on a well tubular, in a production tubing, in a completion tubing, and in a drill pipe. The well typically further comprises one or more sensors at, in or on one or more of a face of the geological structure, the well, an annulus, a casing bore, a production string, a completion string, and a drill string.

At least one of the one or more sensors is typically a wireless sensor. At least one of the one or more sensors is normally an acoustic and/or electromagnetic wireless sensor. The at least one of the one or more sensors is normally electrically powered. The one or more sensors is typically powered by a downhole power source such as a battery.

The one or more sensors may be located internal or external to the well, first inter-casing annulus, second casing bore, well internal tubular, production tubing, completion tubing, and drill pipe. If external the one or more sensors may be ported and/or configured to read conditions internal.

The one or more sensors may sense a variety of parameters including but not limited to one or more of pressure, temperature, load, density and stress. Other optional sensors may sense, but are not necessarily limited to, the one or more of acceleration, vibration, torque, movement, motion, cement integrity, direction and/or inclination, various tubular/casing angles, corrosion and/or erosion, radiation, noise, magnetism, seismic movements, strains on tubular/casings including twisting, shearing, compression, expansion, buckling and any form of deformation, chemical and/or radioactive tracer detection, fluid identification such as hydrate, wax and/or sand production, and fluid properties such as, but not limited to, flow, water cut, pH and/or viscosity. The one or more sensors may be imaging, mapping and/or scanning devices such as, but not limited to, a camera, video, infrared, magnetic resonance, acoustic, ultra-sound, electrical, optical, impedance and capacitance. Furthermore the one or more sensors may be adapted to induce a signal or parameter detected, by the incorporation of suitable transmitters and mechanisms. The one or more sensors may sense the status of equipment within the well, for example a valve position or motor rotation.

Data from the one or more sensors may be used to one or more of optimise, analyse, assess, establish and manipulate properties of the fluid that is introduced into one or more of the first inter-casing annulus, the second casing bore, and a well internal tubular.

The data from the one or more sensors may be used to one or more of optimise, analyse, assess, establish and manipulate properties of the fluid, and typically relies on data collected using the one or more sensors, that is then used and/or processed to suggest changes to the properties of fluid.

Data from the one or more sensors may be collected after the well has been controlled and/or killed to continue to monitor the well constantly or periodically for short or long term periods of days, weeks, months or years.

The one or more sensors are typically attached to one or more of the first and second casing string, a well internal tubular, a production tubing, a completion tubing, and a drill pipe. When the one or more sensors are attached they may be connected to one or more of the first and second casing string, a casing sub, a well internal tubular, a production tubing, a completion tubing, a drill pipe and/or in a wall of one or more of the first and second casing string, a casing sub, a well internal tubular, a production tubing, a completion tubing, and a drill pipe. There may be many suitable forms of connection and/or attachments.

One or more of the primary fluid flow control device, one or more sensors, a battery and a transmitter, receiver or transceiver may be connected on or between a sub, carrier, pup joint, clamp and/or cross-over.

The one or more sensors are typically used to measure at least one of pressure and density of the fluid in at least one of the first inter-casing annulus, and second casing bore. At least one of pressure and density of the fluid in at least one of the first inter-casing annulus and second casing bore, may be measured before opening the primary fluid flow control device and directing the fluid from the first inter-casing annulus into the second casing bore.

It may be an advantage of the present invention that by measuring at least one of pressure and density of the fluid in at least one of the first inter-casing annulus and second casing bore before opening the primary fluid flow control device, fluid can be safely moved around in the well with the confidence that opening the primary flow control device will result in the safe and/or controlled movement of the fluid between the first inter-casing annulus and the second casing bore.

The method typically includes the steps of introducing a fluid into the first inter-casing annulus; opening the primary fluid flow control device; and directing the fluid between the first inter-casing annulus and the second casing bore. When the well further comprises a fluid port in the first inter-casing annulus, the method normally includes the step of introducing a fluid into the first inter-casing annulus through the fluid port. When the well further comprises one or more sensors at, in or on one or more of a face of the geological structure, the well, an annulus, a casing bore, a production string, a completion string, and a drill string, the method normally includes the step of collecting data from the one or more sensors to monitor the well at least periodically for a period of years.

In use, the primary flow control device is typically opened when the pressure of the fluid in the first inter-casing annulus is greater than the pressure of fluid in the second casing bore.

The bottom of the first inter-casing annulus may be open or more typically may be closed by for example a packer or cement barrier.

In use, a fluid may be introduced into the first inter-casing annulus; and opening the primary fluid flow control device, the fluid directed between the first inter-casing annulus and the second casing bore. Introducing the fluid may comprise pumping the fluid.

There are a number of reasons a well in a geological structure may be difficult to control or out of control or it may be difficult to proceed. If there is a well blow-out, it may not be possible to circulate or pump fluids into the well conventionally from the top of the well to control the well. Conventional methods of circulation may include using a well internal string and its outer annulus. The well of the present invention provides an alternative path to pump fluid into the well and/or circulate fluids in the well and thus control the well. If there is a blockage in the well preventing conventional circulation and/or pumping of fluids, the well of the present invention provides an alternative path to pump fluid into the well and/or circulate fluids in the well and thus control the well.

If a drill string becomes stuck in a formation, for example because of 'bridging', it can traditionally be difficult to rectify, and this can cause an increase in well and/or back pressure below a bridge. Likewise, a blow-out or blockage in the well may mean that it is no longer possible to circulate fluid into the second casing bore or a well internal tubular, a production tubing, a completion tubing, and/or a drill pipe in the second casing bore.

It may be an advantage of the present invention that using the well structure, fluid can be directed into the first inter-casing annulus, and then through the primary fluid flow control device into the second casing bore. There is thereby the option to at least contain in part the pressure of fluid in the well. Normally a fluid flow control device below the bridge is used.

The fluid in the second casing bore may be sufficient to gain more control over the well, by killing or at least partially killing it.

The well structure may be used for fluid management and/or may be used for changing the fluid in the first inter-casing annulus and/or the second casing bore to manage well integrity. Managing well integrity may include introducing fluids to mitigate leaks to or from the first inter-casing annulus and/or the second casing bore. Managing well integrity may include introducing fluids into first inter-casing annulus and/or the second casing bore, for instance to control corrosion. The fluids may comprise a chemical, such as a chemical to remove and/or dissolve material in the well, such as a blockage or restriction. Managing well integrity may include introducing cement into first inter-casing annulus and/or the second casing bore. An advantage of managing well integrity may be to reduce the need for early well work over.

Managing well integrity may include one or more of controlling, partially killing and killing the well.

The first fluid flow control device is typically in an un-cemented section in the first inter-casing annulus between the first casing string and the second casing string. The primary fluid flow control device in the second casing string may be in a wall of the second casing string. The primary fluid flow control device in the second casing string may be in or associated with a casing sub of the second casing string. The well may be a pre-existing well. The geological structure may be at least one geological structure of a plurality of geological structures. A pre-existing well may be any kind of borehole and is not limited to producing wells, thus the pre-existing well may be a borehole intended for injection, observational purposes, and economically unfeasible wells, even if they have not and/or will not in future be used to produce fluids.

The well in the geological structure may be one or more of a water well, a well used for carbon dioxide sequestration, and a gas storage well.

The second casing string typically has a diameter less than a diameter of the first casing string.

The fluid flow control device(s) can typically be opened and closed. Opening and/or closing the fluid flow control device may be referred to as activating the fluid flow control device. When the primary fluid flow control device is closed, fluid flow between the first inter-casing annulus and the second casing bore is typically restricted and may be stopped.

A communication system may be installed in the well. The communication system may comprise wireless communication and/or wireless signal(s). The communication system may be installed in the well and may in part be provided on a probe.

In use, data from the one or more sensors in the well may be recovered via the well. The data may help to determine or verify conditions in the well and on occasion be used to determine the location of a fluid leak and/or flow path of a blow-out.

Data from the one or more sensors may be used to check the integrity of the first, and/or second casing string before any fluid flow control device is opened. Checking the integrity of the first and/or second casing string may be used to assess the suitability of a method of fluid flow to control the well.

The integrity of the inter-casing annulus is typically assessed by conducting a pressure test. If a leak is detected, remedial action may be performed to inhibit the leak.

The fluid is typically eventually introduced into the part of the well where it is calculated and/or expected to control and/or kill the well, or where management of the well fluid is desired. This may be the first inter-casing annulus but is often the innermost part of the well, for example a casing bore or tubing. The fluid used to kill the well may be a different fluid than that used to test the integrity of the inter-casing annulus. The fluid for testing could be circulated out of the well before the kill fluid is added. For example, a heavier fluid may be used to kill the well.

The well may have one or more of a perforating device, pyrotechnic device, explosive device, puncture device, rupture mechanism and valve in the first casing string, typically a wall of the first casing string, and/or a sub of the first casing string, to provide fluid communication between an outside of the first casing string and the first inter-casing annulus. The one or more of the perforating device, pyrotechnic device, explosive device, puncture device, rupture mechanism and valve in the first casing string is typically in an un-cemented section, normally externally un-cemented section. There may be cement and/or a packer above and/or below the un-cemented section.

The one or more of a perforating device, pyrotechnic device, explosive device, puncture device, rupture mechanism and valve in the first casing string may be referred to as an outer fluid flow control device.

A bottom of any inter-casing annulus may be open or more typically may be closed for example by a packer or cement barrier. References herein to cement include cement substitute. A solidifying cement substitute may include epoxies and resins, or a non-solidifying cement substitute such as Sandaband™.

The well may further comprise a transmitter, receiver or transceiver attached to one or more of the first and second casing strings, a well internal tubular, a production tubing, a completion tubing, and a drill pipe. When the transmitter, receiver or transceiver is attached it may be connected to one or more of the first and second casing strings and/or in a wall of the first or second casing strings. There may be many suitable forms of connection. The at least one of a transmitter, receiver or transceiver attached to one or more of the first and second casing strings, a well internal tubular, a production tubing, a completion tubing, and a drill pipe is typically battery powered.

The one or more sensors may be physically and/or wirelessly coupled to the transmitter, receiver or transceiver. Repeaters may be provided in the well. The data may be live data and/or historical data. Data may be stored downhole for later transmission.

The transmitters, receivers or transceivers may communicate with each other at least partially wirelessly and/or using a wireless signal and/or wireless communication. This may be by an acoustic signal and/or electromagnetic signal and/or pressure pulse, and/or inductively coupled tubular. The wireless signal may be an acoustic and/or electromagnetic signal. The wireless signal may be referred to as wireless communication.

In use, the transmitter, receiver or transceiver may be used to recover data from the well. In use, the wireless signal may be transmitted through the well to open and/or close the primary fluid flow control devices.

It may not be possible to collect downhole data at a surface location, on for example a rig or platform, associated with a blown-out well. A transponder or transponders may therefore be deployed into the sea from a vessel nearby and signals sent to the transponder(s) on or adjacent to a subsea structure of the blown-out well. If for any reason these are damaged or have been destroyed in the blow-out, additional transponders can be retrofitted at any time.

By retrieving data, particularly data from the one or more sensors, the condition of the well may be evaluated and an operator may be able to safely design and/or adapt a method of controlling the well. In addition, density and/or volume of the fluid required to control/kill the well may be accurately calculated.

The wireless signal may be transmitted in at least one or more of the following forms: electromagnetic, acoustic, inductively coupled tubulars and coded pressure pulsing. References herein to "wireless" relate to said forms, unless where stated otherwise.

Pressure pulses are a way of communicating from/to within the well/borehole, from/to at least one of a further location within the well/borehole, and the surface of the well/borehole, using positive and/or negative pressure changes, and/or flow rate changes of a fluid in a tubular and/or annulus.

Coded pressure pulses are such pressure pulses where a modulation scheme has been used to encode commands within the pressure or flow rate variations and a transducer is used within the well/borehole to detect and/or generate the variations, and/or an electronic system is used within the well/borehole to encode and/or decode commands. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Where coded pressure pulses are used to transmit control signals, various modulation schemes may be used such as a pressure change or rate of pressure change, on/off keyed (OOK), pulse position modulation (PPM), pulse width modulation (PWM), frequency shift keying (FSK), pressure shift keying (PSK), and amplitude shift keying (ASK). Combinations of modulation schemes may also be used, for example, OOK-PPM-PWM. Data rates for coded pressure modulation schemes are generally low, typically less than 10 bps, and may be less than 0.1 bps. Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected into the well.

Preferably the wireless signals are such that they are capable of passing through a barrier, such as a plug, when fixed in place. Preferably therefore the wireless signals are transmitted in at least one of the following forms: electromagnetic (EM), acoustic, and inductively coupled tubulars.

The signals may be data or control signals which need not be in the same wireless form. Accordingly, the options set out herein for different types of wireless signals are independently applicable to data and control signals. The control signals can control downhole devices, including the sensors. Data from the sensors may be transmitted in response to a control signal. Moreover, data acquisition and/or transmission parameters, such as acquisition and/or transmission rate or resolution, may be varied using suitable control signals.

EM/acoustic and coded pressure pulsing use the well, borehole or formation as the medium of transmission. The EM/acoustic or pressure signal may be sent from the well, or from the surface. If provided in the well, an EM/acoustic signal can travel through any annular sealing device, although for certain embodiments, it may travel indirectly, for example around any annular sealing device.

Electromagnetic and acoustic signals are especially preferred—they can transmit through/past an annular sealing device or barrier or annular barrier without special inductively coupled tubulars infrastructure, and for data transmission, the amount of information that can be transmitted is normally higher compared to coded pressure pulsing, especially data from the well.

The transmitter, receiver and/or transceiver used correspond with the type of wireless signals used. For example an acoustic transmitter and receiver and/or transceiver are used if acoustic signals are used.

Where inductively coupled tubulars are used, there are normally at least ten, usually many more, individual lengths of inductively coupled tubular which are joined together in use, to form a string of inductively coupled tubulars. They have an integral wire and may be formed from tubulars such as tubing, drill pipe, or casing. At each connection between adjacent lengths there is an inductive coupling. The inductively coupled tubulars that may be used can be provided by NOV under the brand Intellipipe®.

Thus, the EM/acoustic or pressure wireless signals can be conveyed a relatively long distance as wireless signals, sent for at least 200 meters, optionally more than 400 meters or longer which is a clear benefit over other shorter range signals. Embodiments including inductively coupled tubulars provide this advantage/effect by the combination of the integral wire and the inductive couplings. The distance travelled may be much longer, depending on the length of the well.

Data and/or commands within the signal may be relayed or transmitted by other means. Thus the wireless signals could be converted to other types of wireless or wired signals, and optionally relayed, by the same or by other means, such as hydraulic, electrical and fibre optic lines. In one embodiment, the signals may be transmitted through a cable for a first distance, such as over 400 meters, and then transmitted via acoustic or EM communications for a smaller distance, such as 200 meters. In another embodiment they are transmitted for 500 meters using coded pressure pulsing and then 1000 meters using a hydraulic line.

Thus whilst non-wireless means may be used to transmit the signal in addition to the wireless means, preferred configurations preferentially use wireless communication. Thus, whilst the distance travelled by the signal is dependent on the depth of the well, often the wireless signal, including relays but not including any non-wireless transmission, travel for more than 1000 meters or more than 2000 meters. Preferred embodiments also have signals transferred by wireless signals (including relays but not including non-wireless means) at least half the distance from the surface of the well to apparatus in the well including fluid flow control device(s) and one or more sensors.

Different wireless and/or wired signals may be used in the same well for communications going from the well towards the surface, and for communications going from the surface into the well.

Thus, the wireless signal may be sent directly or indirectly, for example making use of in-well relays above and/or below any sealing device or annular sealing device. The wireless signal may be sent from the surface or from a wireline/coiled tubing (or tractor) run probe at any point in the well. For certain embodiments, the probe may be positioned relatively close to any sealing device or annular sealing device for example less than 30 meters therefrom, or less than 15 meters.

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

The acoustic signals and communications may be unidirectional or bi-directional. Piezoelectric, moving coil transducer or magnetostrictive transducers may be used to send and/or receive the signal.

Electromagnetic (EM) (sometimes referred to as Quasi-Static (QS)) wireless communication is normally in the frequency bands of: (selected based on propagation characteristics)

sub-ELF (extremely low frequency)<3 Hz (normally above 0.01 Hz);

ELF 3 Hz to 30 Hz;

SLF (super low frequency) 30 Hz to 300 Hz;

ULF (ultra low frequency) 300 Hz to 3 kHz; and,

VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive. U.S. Pat. No. 5,831,549 describes a telemetry system involving gigahertz transmission in a gas filled tubular waveguide.

Sub-ELF and/or ELF are preferred for communications from a well to the surface (e.g. over a distance of above 100 meters). For more local communications, for example less than 10 meters, VLF is preferred. The nomenclature used for these ranges is defined by the International Telecommunication Union (ITU).

EM communications may include transmitting communication by one or more of the following: imposing a modulated current on an elongate member and using the earth as return; transmitting current in one tubular and providing a return path in a second tubular; use of a second well as part of a current path; near-field or far-field transmission; creating a current loop within a portion of the well metalwork in order to create a potential difference between the metalwork and earth; use of spaced contacts to create an electric dipole transmitter; use of a toroidal transformer to impose current in the well metalwork; use of an insulating sub; a coil antenna to create a modulated time varying magnetic field for local or through formation transmission; transmission within the well casing; use of the elongate member and earth as a coaxial transmission line; use of a tubular as a wave guide; transmission outwith the well casing.

Especially useful is imposing a modulated current on an elongate member and using the earth as return; creating a current loop within a portion of the well metalwork in order to create a potential difference between the metalwork and earth; use of spaced contacts to create an electric dipole transmitter; and use of a toroidal transformer to impose current in the well metalwork.

To control and direct current advantageously, a number of different techniques may be used. For example one or more of: use of an insulating coating or spacers on well tubulars; selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz to 30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna.

Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a well with electrically conductive casing is disclosed in U.S. Pat. No. 5,394,141 by Soulier and U.S. Pat. No. 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

A relay comprises a transceiver (or receiver) which can receive a signal, and an amplifier which amplifies the signal for the transceiver (or a transmitter) to transmit it onwards.

The well typically includes multiple components, including the fluid flow control device(s) and one or more sensors and/or wireless communication devices. Any of the components of the well may be referred to as well apparatus.

There may be at least one relay. The at least one relay (and the transceivers or transmitters associated with the well or at the surface) may be operable to transmit a signal for at least 200 meters through the well. One or more relays may be configured to transmit for over 300 meters, or over 400 meters.

For acoustic communication there may be more than five, or more than ten relays, depending on the depth of the well and the position of well apparatus.

Generally, less relays are required for EM communications. For example, there may be only a single relay. Optionally therefore, an EM relay (and the transceivers or transmitters associated with the well or at the surface) may be configured to transmit for over 500 meters, or over 1000 meters.

The transmission may be more inhibited in some areas of the well, for example when transmitting across a packer. In this case, the relayed signal may travel a shorter distance. However, where a plurality of acoustic relays are provided, preferably at least three are operable to transmit a signal for at least 200 meters through the well.

For inductively coupled tubulars, a relay may also be provided, for example every 300-500 meters in the well.

The relays may keep at least a proportion of the data for later retrieval in a suitable memory means.

Taking these factors into account, and also the nature of the well, the relays can therefore be spaced apart accordingly in the well.

The control signals may cause, in effect, immediate activation, or may be configured to activate the well apparatus after a time delay, and/or if other conditions are present such as a particular pressure change.

The well apparatus may comprise at least one battery optionally a rechargeable battery. Each device/element of the well apparatus may have its own battery, optionally a rechargeable battery. The battery may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the well. Reserve batteries may comprise a battery where the electrolyte is retained in a reservoir and is combined with the anode and/or cathode when a voltage or usage threshold on the active battery is reached.

The battery and optionally elements of control electronics may be replaceable without removing tubulars. They may be replaced by, for example, using wireline or coiled tubing. The battery may be situated in a side pocket.

The battery typically powers components of the well apparatus, for example a multi-purpose controller, a monitoring mechanism and a transceiver. Often a separate battery is provided for each powered component. In alternative embodiments, downhole power generation may be used, for example, by thermoelectric generation.

The well apparatus may comprise a microprocessor. Electronics in the well apparatus, to power various components such as the microprocessor, control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised short range wireless (for example EM in the VLF range) communication techniques can be used between different components of the system to minimize the time that individual components need to be kept 'awake', and hence maximise 'sleep' time and power saving.

The low power electronics facilitates long term use of various components. The electronics may be configured to be controllable by a control signal up to more than 24 hours after being run into the well, optionally more than 7 days, more than 1 month, or more than 1 year or up to 5 years. It can be configured to remain dormant before and/or after being activated.

The well is often an at least partially vertical well. Nevertheless, it can be a deviated or horizontal well. References such as "above" and "below" when applied to deviated or horizontal wells should be construed as their equivalent in wells with some vertical orientation. For example, "above" is closer to the surface of the well.

The well described herein is typically a naturally flowing well, that is fluid naturally flows up the well to surface, and/or fluid flows to the surface unassisted or unaided.

Features and optional features of the fourth aspect of the present invention may be incorporated into the first, second and/or third aspects of the present invention and vice versa.

Embodiments of the present invention will now be described, by way of example only, with reference to the accompanying drawings, in which.

Figure 1:
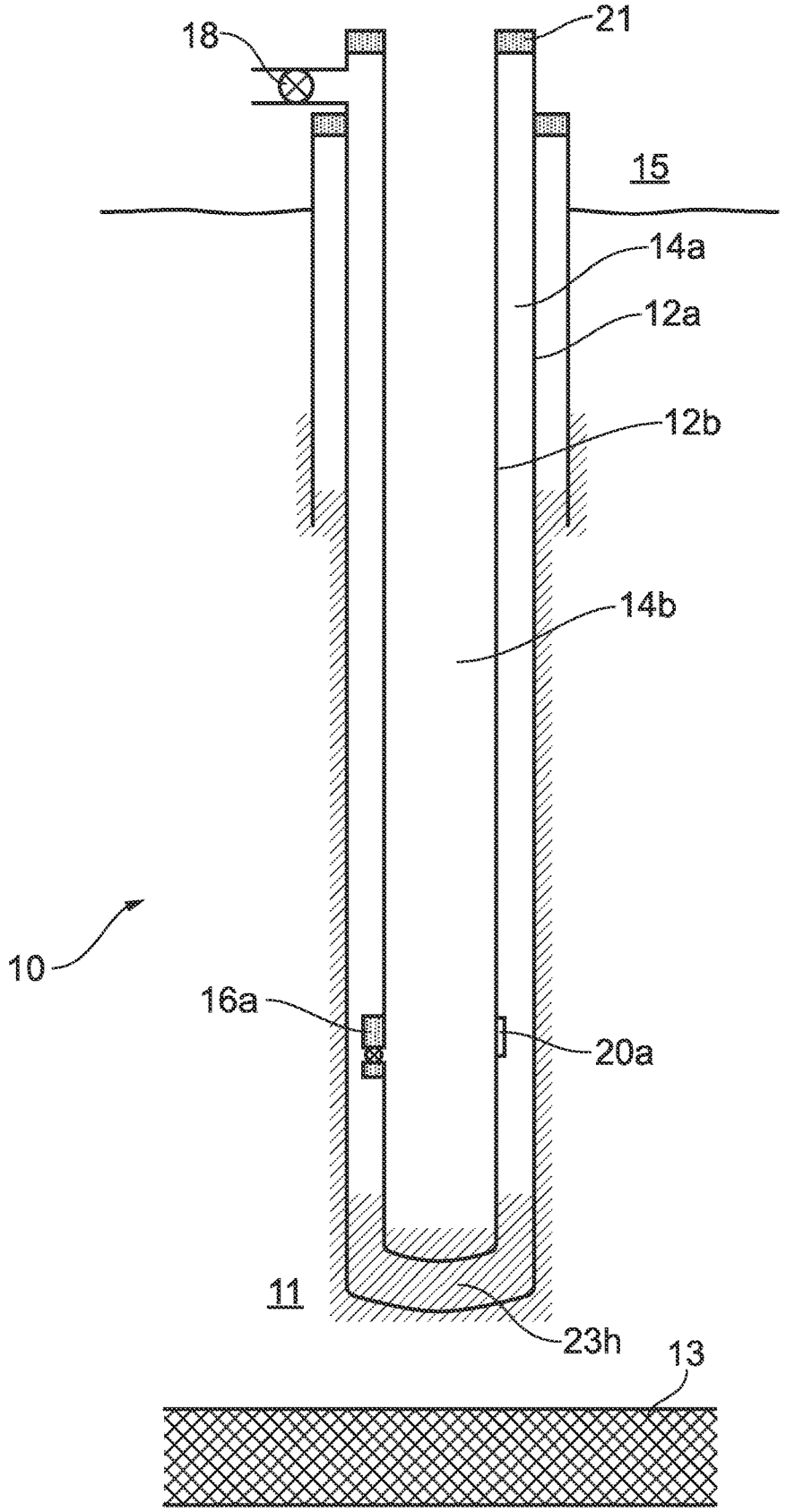
FIG. 1 is a cross-sectional view of a well during construction.

FIG. 1 shows a well 10 in a geological structure 11. The well 10 has a first 12*a* and a second 12*b* casing string. The first and second casing string each having a proximal and distal end, the proximal ends are closest to the surface 15. The distal ends are closest to a permeable formation of the reservoir 13. The second casing string 12*b* is inside the first casing string 12*a*. The first 12*a* and second 12*b* casing strings define a first inter-casing annulus 14*a* therebetween. The second casing string 12*b* defines a second casing bore 14*b* therewithin. A primary fluid flow control device 16*a* in the second casing string 12*b* provides fluid communication between the first inter-casing annulus 14*a* and the second casing bore 14*b*. The distal ends of the first 12*a* and second 12*b* casing strings are in an impermeable formation 11, not a permeable formation 13 of the reservoir.

A fluid (not shown) is introduced into the first inter-casing annulus 14*a* through a fluid port 18. The primary fluid flow control device 16*a* is then opened and the fluid (not shown) directed between the first inter-casing annulus 14*a* and the second casing bore 14*b*. The fluid has not been shown in any of the figures so as not to over complicate the drawings.

The primary fluid flow control device 16*a* comprises a valve and a rupture mechanism.

The bottom of both the first 12*a* and second 12*b* casing strings has been cemented 23*h*. The fluid, in this case a drilling mud (not shown), is sealed in the first inter-casing annulus 14*a*, at the top by a casing hanger 21 and at the bottom by the cement 23*h*.

The second casing string 12*b* has sensors 20*a* to measure fluid pressure and density in the first inter-casing annulus 14*a*. Data from the sensors 20*a* is used to optimise properties of the fluid that is directed between the annulus 14*a* and casing bore 14*b*. Additionally, the sensors 20*a* on the second casing string 12*b* may be ported to measure fluid pressure and density in the first inter-casing annulus 14*a* and the second casing bore 14*b*.

Using the sensors 20*a* the pressure and density of the fluid in the first inter-casing annulus 14*a* and second casing bore 14*b* are measured before opening the primary fluid flow control device 16*a* and directing the fluid from the first inter-casing annulus 14*a* into the second casing bore 14*b*.

A wireless electromagnetic signal is transmitted through the well 10 to open the primary fluid flow control device 16*a* and direct the fluid between the first inter-casing annulus 14*a* and the second casing bore 14*b*. Alternatively the wireless signal is an acoustic wireless signal.

In an open position, the primary fluid flow control device 16*a* has a cross-sectional fluid flow area of more than 100 $mm^2$.

The sensors 20*a* are coupled to acoustic transceivers (not shown). The sensors 20*a* measure the temperature, pressure and density of the fluid. Alternatively, the sensors are coupled to electromagnetic transceivers.

It may be an advantage of the present invention that access and fluid control into and/or between the first inter-casing annulus 14*a* and the second casing bore 14*b* has now been made possible by use of the first fluid flow control device 16*a*. Conventionally, in a subsea well the first inter-casing annulus is sealed at the top and the bottom and circulation through this annulus is not possible.

FIG. 1 shows an embodiment of the well that may be a subsea well and incorporating a non-conventional feature of the fluid port 18.

The fluid port may be wirelessly controlled.

Figure 2:
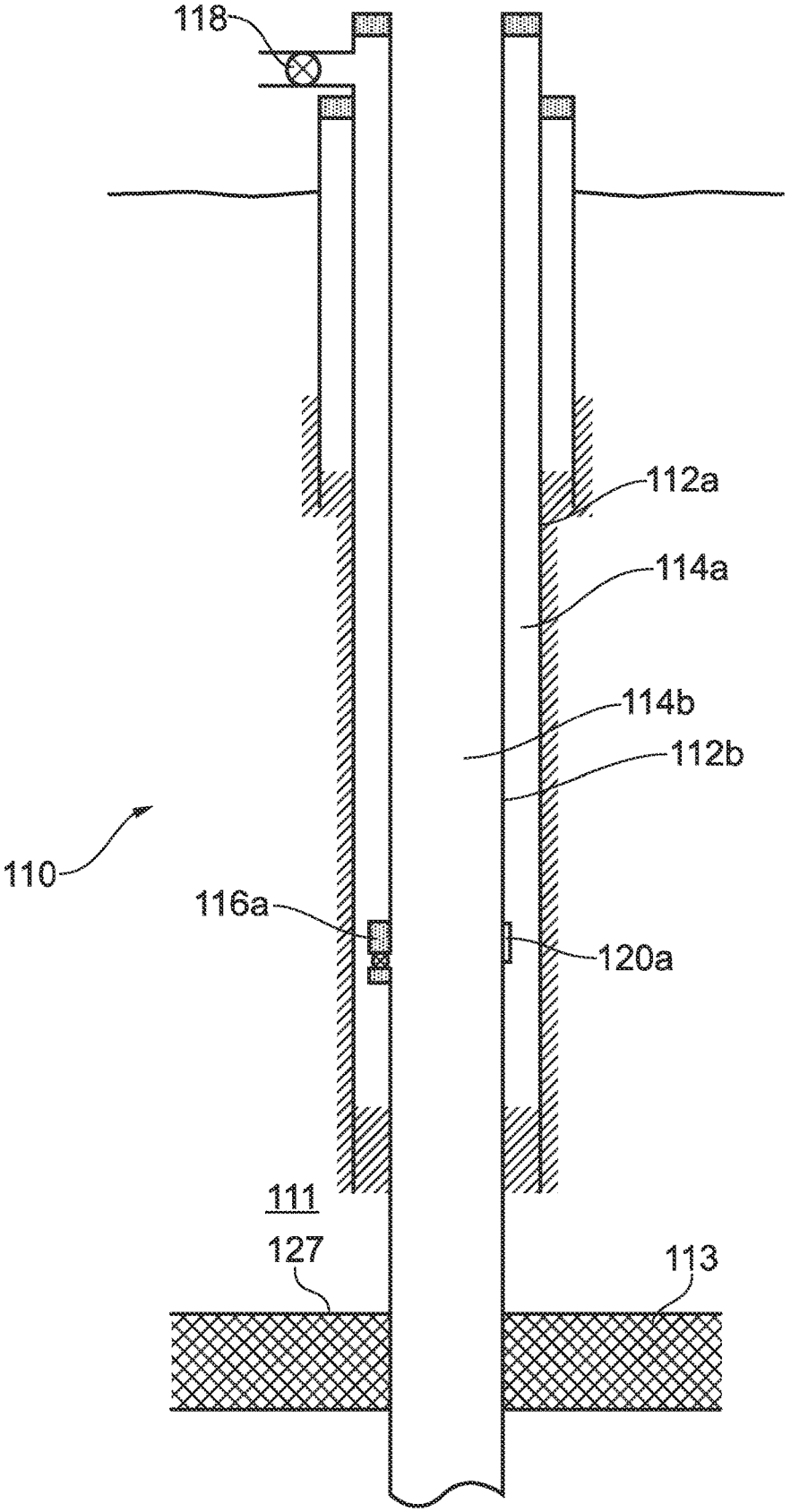
FIG. 2 is a cross-sectional view of the same well during drilling.

FIG. 2 shows the same well during the operation of drilling through the reservoir. The drill string has been removed from the well 110. Features of the well shown in FIG. 1 that are also shown in FIG. 2 have been given the same reference number with a prefix 1, so the first casing string is 12*a* in FIGS. 1 and 112*a* in FIG. 2. Other well control structures may be present that are not shown.

FIG. 2 shows a casing bore 114*b* that can be managed and controlled by flowing fluid from the outside of the well to the inside, through the fluid port 118 into the first inter-casing annulus 114*a*, through the primary fluid flow control device 116*a* into the second casing bore 114*b*. The lowermost or distal end of the first casing string 112*a* is 40 meters from the interface 127 between the reservoir or permeable formation 113 and the impermeable formation 111. The interface 127 is also referred to as an upper communication path.

Up-to-date data can be collected from the sensors 120*a* which provide information on the conditions in the first inter-casing annulus 114*a*, also referred to as the B annulus, and casing bore 114*b*. If the downhole conditions are monitored, usually via wireless data collection, the drilling mud density and volume required to be pumped into the well/formation(s) can be calculated to avoid the possibility of causing a subterranean blow-out by rupturing the casing string and surrounding formation(s).

It may be an advantage of the present invention that the sensor 120*a* provides means of measuring the well bore pressure proximate to the reservoir 113. Conventionally this would not be possible when an internal string is not present in the well. This provides useful data for the method of fluid management.

In this embodiment we have the option to reclose the inter-casing valve 116*a* to maintain the integrity of the casing string 112*b*.

Embodiments of the present invention provide a feedback system which allows better management of a hazardous control and/or kill procedure, because it is based on sensor readings rather than estimates of for example the well pressure. Moreover, monitoring can continue as the well is being controlled and/or killed, so that the control/kill procedure is adjusted and optimised according to the information being received.

It may be an advantage of the present invention that the well provides for significantly quicker control of a well compared to known methods, such as re-entering a well by capping and installing a new well internal tubular. The saving may be several days, weeks or even months, reducing the potential damage to the surrounding environment as well as saving a very significant amount of time and money.

The primary fluid flow control device 116*a* is low and deep in the well. This is particularly useful for high temperature and/or high pressure wells.

Internal tubulars (not shown in FIG. 2) may be present, such as a drill string. The well of the present invention provides the ability to circulate fluid in the well, particularly when a drill string is not present.

Figure 3:
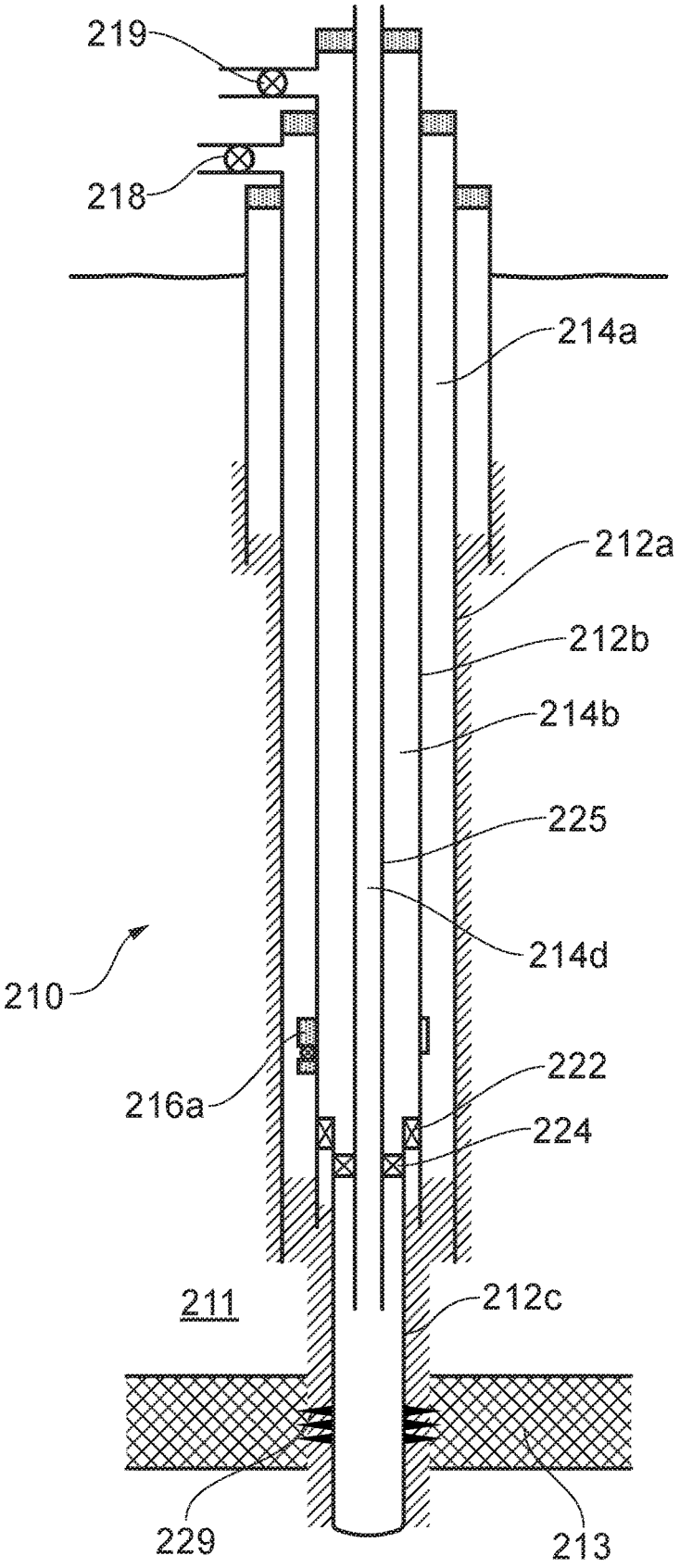
FIG. 3 is a cross-sectional view the same well when completed.

FIG. 3 shows a completed well with an inner string, in this embodiment a tubular 225. The tubular 225 defines an inner bore 214*d* therewithin. Features of the well shown in FIGS. 1 and 2 that are also shown in FIG. 3 have been given the same reference number with a prefix 2, so the first casing string is 12*a* in FIGS. 1 and 212*a* in FIG. 3.

FIG. 3 shows a well 210 in which fluid flow can be managed and controlled by flowing fluid in a cascade from the outside of the well to the inside, through the fluid port 218 into the first inter-casing annulus 214*a*, through the primary fluid flow control device 216*a* into the second casing bore 214*b* and back out the well through the fluid port 219.

The well in the geological structure 211 comprises a reservoir 213 that contains hydrocarbons. There is an uppermost communication path 229, that is the communication path that is closest to surface (at the top of FIG. 3). The communication path 229 is a perforation created in a liner 212*c* by a perforating gun. The lowermost or distal end of the first casing string 212*a* is 45 meters from the uppermost communication path 229 of the well.

The distal ends of the first 212*a* and second 212*b* casing strings are in an impermeable formation 211, not the permeable formation 213 of the reservoir. The impermeable formation may be and/or may be described as a substantially impermeable formation. The permeable formation may be and/or may be described as a substantially permeable formation.

The first casing string 212*a* is less than 100 meters longer in length than the second casing string 212*b*. The proximal end of the first casing string 212*a* is within 5 meters of the proximal end of the second casing string 212*b*. The distal end of the first casing string 212*a* is within 50 meters of the distal end of the second casing string 212*b*.

In one embodiment, the well of the present invention can be used to control fluid flow in the well in the event of the failure of the packer 224 or casing hanger 222.

In a further embodiment a fluid port may be provided in the internal string and fluid managed via this port rather than port 219.

In alternative embodiments the inner string may be any other tubular string, such as a drill string, a completion string, a production string, a test string, drill stem test (DST) string, a further casing string and liner.

Devices such as fluid control devices and sensors associated with strings, such as casing strings, tubing strings, production strings, drilling strings, may be associated with a sub-component of the string such as tubular joints, subs, carriers, packers, cross-overs, clamps, pup joints, and collars etc.

Improvements and modifications may be incorporated herein without departing from the scope of the invention.

That claimed is:

1. A well in a geological structure, the well comprising:

a first and a second casing string, the second casing string inside the first casing string;

the first and second casing strings defining a first inter-casing annulus therebetween, the second casing string defining a second casing bore therewithin;

a primary fluid flow control device in the second casing string to direct a fluid introduced into the first inter-casing annulus to the second casing bore;

wherein the first or second casing string is less than 250 meters longer in length than the second or first casing string respectively; and wherein the primary fluid flow control device comprises a wirelessly controllable valve; and in an open position, the primary fluid flow control device has a cross sectional fluid flow area of at least 100 $mm^2$, the cross sectional fluid flow area being sufficient to enhance the fluid to flow from the first inter-casing annulus to the second casing bore.

2. A well according to claim 1, wherein the first or second casing string is less than 50 meters longer in length than the second or first casing string respectively.

3. A well according to claim 1, wherein the first and the second casing strings are the same length.

4. A well according to claim 1, further comprising at least one communication path providing fluid communication between the reservoir and the well, and wherein the primary fluid flow control device is within 1500 m from the communication path of the well between the reservoir and the well.

5. A well according to claim 1, wherein the primary fluid flow control device further comprises a rupture mechanism.

6. A well according to claim 1, wherein the primary fluid flow control device further comprises a check valve.

7. A well according to claim 1, wherein the wirelessly controllable valve includes a metal to metal seal.

8. A well according to claim 1, wherein the wirelessly controllable valve is moveable to a check position which is between a closed position and an open position.

9. A well according to claim 1, the well further comprising one or more sensors at, in or on one or more of a face of the geological structure, the well, an annulus, a casing bore, a production string, a completion string, a tubing string, a sub, and a drill string.

10. A well according to claim 9, wherein at least one of the one or more sensors is a wireless sensor.

11. A well according to claim 10, wherein at least one of the one or more sensors is an acoustic and/or electromagnetic wireless sensor.

12. A well according to claim 9, wherein at least one of the one or more sensors is electrically powered.

13. A well according to claim 1, wherein the valve of the primary fluid flow control device is at least one of an acoustic and electromagnetic wirelessly controllable valve.

14. A well according to claim 1, wherein the primary flow control device is electrically powered.

15. A well according to claim 1, wherein at least one of a transmitter, receiver or transceiver is attached to one or more of the first and second casing strings, a well internal tubular, a production tubing, a completion tubing, and a drill pipe, is electrically, optionally battery powered.

16. A well according to claim 1, wherein the first and second casing strings each having a proximal and a distal end, the proximal ends being the end closest to the surface.

17. A well according to claim 16, wherein the proximal end of the first casing string within 5 meters of the proximal end of the second casing string, the distal end of the first casing string within 50 meters of the distal end of the second casing string.

18. A well according to claim 16, wherein the distal ends of the first and second casing strings are in an impermeable or at least substantially impermeable formation.

19. A well according to claim 16, wherein the distal ends of the first and second casing strings are not in a permeable formation.

20. A well according to claim 16, wherein the distal end of the second casing string is inside the first casing string.

21. A well according to claim 16, wherein the primary fluid flow control device is within 500 m of the shallower of the distal ends.

22. A method of fluid management utilizing a well; the well comprising:

a first and a second casing string, the second casing string inside the first casing string, the first and second casing strings each having a proximal and a distal end, the proximal ends being the end closest to the surface;

the first and second casing strings defining a first inter-casing annulus therebetween, the second casing string defining a second casing bore therewithin;

a primary fluid flow control device in the second casing string to provide fluid communication between the first inter-casing annulus and the second casing bore;

wherein the first or second casing string is less than 250 meters longer in length than the second or first casing string respectively; and wherein the primary fluid flow control device comprises a wirelessly controllable valve;

in an open position the primary fluid flow control device has a cross sectional fluid flow area of at least 100 $mm^2$; and the method including the steps of introducing a fluid into the first inter-casing annulus; opening the primary fluid flow control device; and directing the fluid between the first inter-casing annulus and the second casing bore.

23. A method of fluid management according to claim 22, wherein the well further comprises a fluid port in the first inter-casing annulus, the method including the step of introducing a fluid into the first inter-casing annulus through the fluid port.

24. A method as claimed in claim 22, comprising directing fluids through the primary fluid flow control device whilst drilling.

* * * * *